US011834320B1

(12) United States Patent
Carley

(10) Patent No.: US 11,834,320 B1
(45) Date of Patent: Dec. 5, 2023

(54) FLUID DELIVERY SUBSYSTEMS FOR BEVERAGE DISPENSING APPARATUS

(71) Applicant: BARTESIAN CORP., Chicago, IL (US)

(72) Inventor: Matthew T. Carley, Richmond, VA (US)

(73) Assignee: BARTESIAN CORP.

( * ) Notice: Subject to any disclaimer, the term of this patent is extended or adjusted under 35 U.S.C. 154(b) by 0 days.

(21) Appl. No.: 17/835,707

(22) Filed: Jun. 8, 2022

(51) Int. Cl.
*B67D 1/00* (2006.01)
*B67D 1/12* (2006.01)

(52) U.S. Cl.
CPC ..... *B67D 1/0037* (2013.01); *B67D 1/1277* (2013.01)

(58) Field of Classification Search
CPC .. B67D 1/0078; B67D 1/0021; B67D 1/0041; B67D 1/0802; B67D 1/0842; B67D 1/0888; B67D 1/10; B67D 1/1247; B67D 2001/0814; B67D 2001/082
See application file for complete search history.

(56) References Cited

U.S. PATENT DOCUMENTS

2018/0186621 A1* 7/2018 Jangbarwala ..... B67D 1/07
2019/0031984 A1* 1/2019 Chong ..... B67D 1/0078
2022/0356056 A1* 11/2022 Sergyeyenko ..... B67D 1/0037

* cited by examiner

*Primary Examiner* — Donnell A Long
(74) *Attorney, Agent, or Firm* — Perry + Currier

(57) ABSTRACT

A beverage dispensing apparatus includes: a plurality of reservoirs configured to supply respective fluids for delivery to an injection assembly having a single fluid input; a fluid delivery manifold defining a chamber, and having (i) for each of the reservoirs, a respective chamber inlet, and (ii) a single chamber outlet; for each chamber inlet, a respective valve configured to selectably open or close the corresponding chamber inlet; for each reservoir, a respective input conduit connected to a corresponding chamber inlet, to deliver fluid from the reservoir into the chamber; and an output conduit connected between the single chamber outlet and the single fluid input of the injection assembly, to deliver fluid from the chamber to the injection assembly.

8 Claims, 6 Drawing Sheets

FLUID DELIVERY SUBSYSTEMS FOR BEVERAGE DISPENSING APPARATUS

BACKGROUND

Beverage dispensing devices accept capsules containing various flavoring and/or coloring materials (e.g., powders, liquids, and the like). To produce a beverage, a dispensing apparatus is generally configured to inject fluid (e.g., water, spirits, or the like) into a capsule, mixing the fluid with the materials in the capsule, following which the mixed fluid can be extracted from the capsule. The dispensing apparatus may contain various conduits to carry fluid from reservoirs to an injector. The conduits, and the connections between the conduits and other components, may be susceptible to wear and/or leaks. The conduits may also accumulate residual fluids, leading to contamination of subsequent beverages.

SUMMARY

A beverage dispensing apparatus includes; a plurality of reservoirs configured to supply respective fluids for delivery to an injection assembly having a single fluid input; a fluid delivery manifold defining a chamber, and having (i) for each of the reservoirs, a respective chamber inlet, and (ii) a single chamber outlet; for each chamber inlet, a respective valve configured to selectably open or close the corresponding chamber inlet; for each reservoir, a respective input conduit connected to a corresponding chamber inlet, to deliver fluid from the reservoir into the chamber; and an output conduit connected between the single chamber outlet and the single fluid input of the injection assembly, to deliver fluid from the chamber to the injection assembly.

BRIEF DESCRIPTIONS OF THE DRAWINGS

Embodiments are described with reference to the following figures.

DETAILED DESCRIPTION

Figure 1:
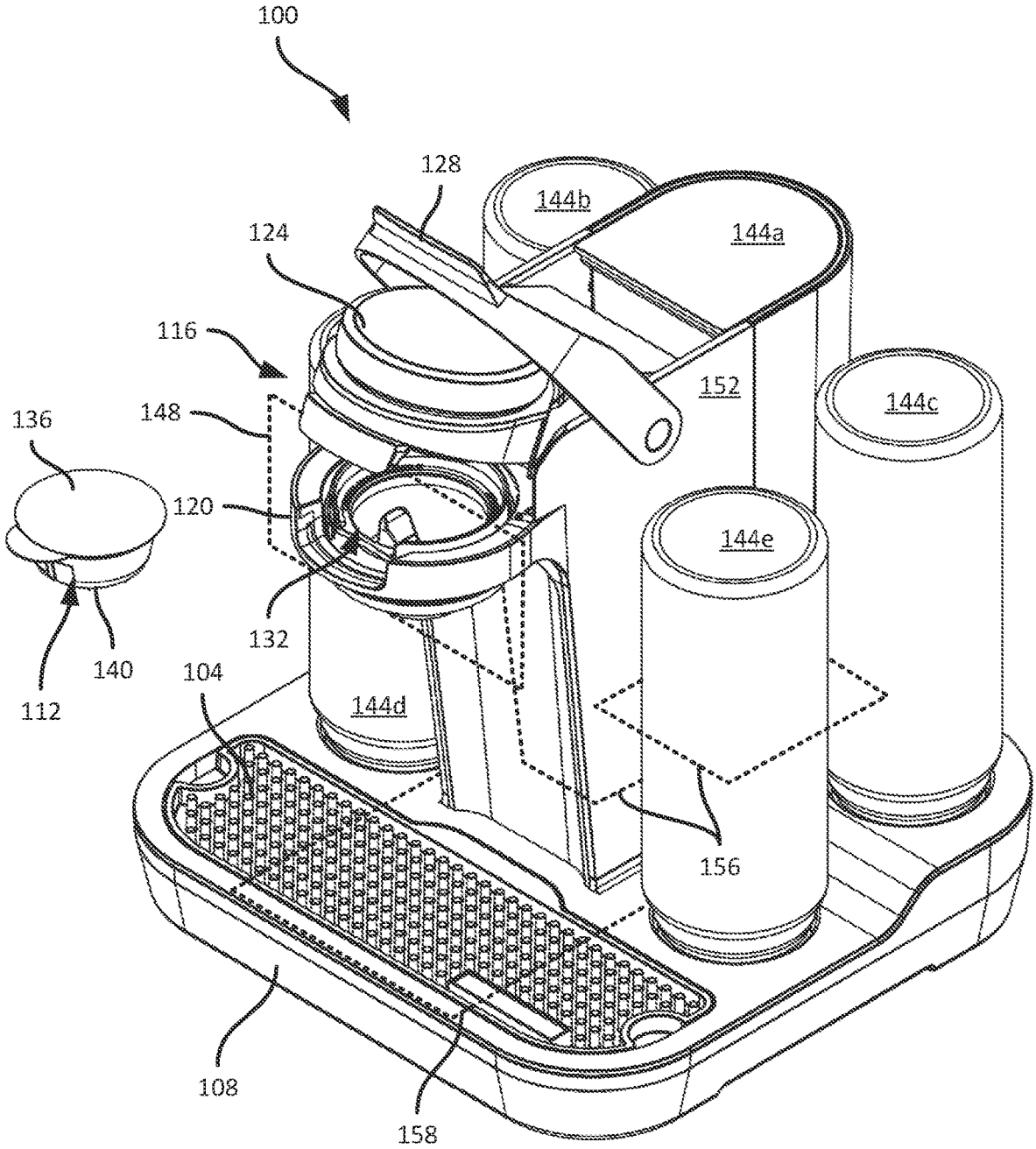
FIG. 1 is an isometric view of a beverage dispensing apparatus and a capsule for use in the beverage dispensing apparatus.

FIG. 1 depicts a beverage dispensing apparatus 100, also referred to herein as the dispensing apparatus 100 or simply the apparatus 100. The apparatus 100 enables the production of beverages, dispensed into a suitable receptacle (e.g., a glass, mug or the like) placed on a tray or other support surface 104 defined by a base 108 of the apparatus 100. The apparatus 100 produces a beverage via the placement of a capsule 112 (shown prior to insertion in the apparatus 100) into a dispensing head assembly 116 of the apparatus 100. The dispensing head 116, in the illustrated example, includes a fixed lower portion 120 (referred to as fixed as a result of being substantially immovable relative to a the base 108 of the apparatus 100), and a movable upper portion, or cover, 124. The cover 124 is movable between an open position shown in FIG. 1, and a closed position, e.g., via manipulation of a handle 128.

The lower portion 120 of the dispensing head 116 supports a capsule holder 132. With the cover 124 in the open position, the capsule 112 can be inserted into the capsule holder 132. The cover 124 can then be closed, enclosing the capsule holder 132 and the capsule 112 between the cover 124 and the lower portion 120. Closure of the cover 124 also, as will be discussed below, pierces an upper wall 136 (e.g., a foil cover or the like) of the capsule 112 with an injector mounted to the cover 124, and pierces a lower wall 140 of the capsule 112 with an extractor mounted within the capsule holder 132.

The apparatus 100 can then inject (via the injector mentioned above) fluid into the capsule 112, e.g., from any one or more of a set of reservoirs 144*a*, 144*b*, 144*c*, 144*d*, and 144*e*. For example, the reservoir 144*a* can contain water, while the reservoirs 144*b* through 144*e* can contain various spirits (e.g., vodka in the reservoir 144*b*, whiskey in the reservoir 144*c*, gin in the reservoir 144*d*, and rum in the reservoir 144*e*). A wide variety of other fluids are also contemplated, however, and the number and placement of reservoirs 144 can also vary in other implementations. As will be apparent to those skilled in the art, fluid injected into the capsule 112 mixes with the materials contained within the capsule 112, and the mixed fluid exits the capsule 112 through the above-mentioned extractor, for dispensing into a receptacle placed on the support surface 104. Certain additional features of the dispensing head 116 are discussed below in connection with FIG. 2, which illustrates the lower portion 120 in cross section, taken at the section plane 148.

Figure 2:
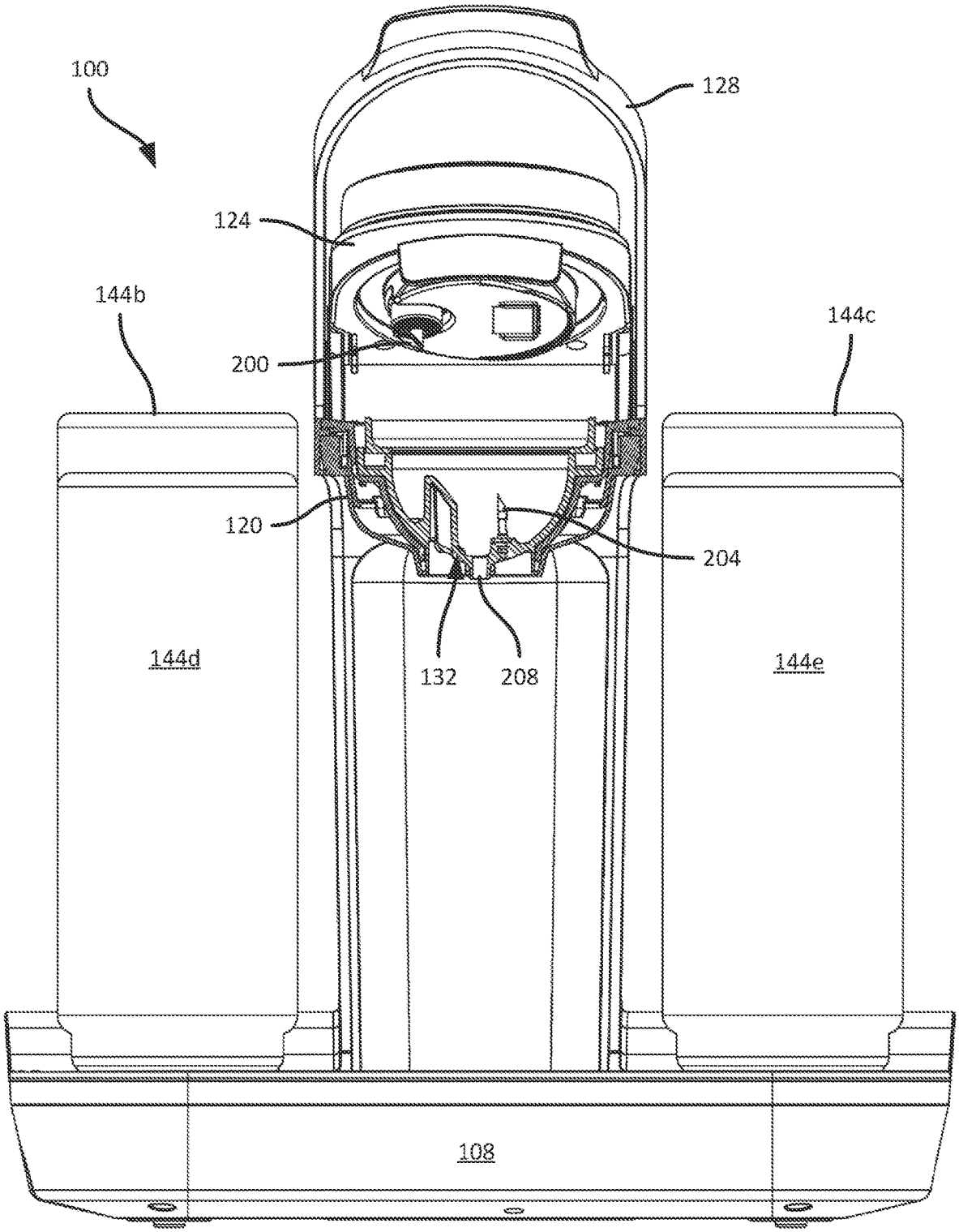
FIG. 2 is a front view of the beverage dispensing apparatus of FIG. 1, with a dispensing head assembly shown in partial cross section.

FIG. 2 illustrates a front view of the apparatus 100, with the lower portion 120 of the dispensing head 116, as well as the capsule holder 132, shown in cross section taken at the plane 148 mentioned above. As seen in FIG. 2, an injector 200 (e.g., a hollow needle) mounted to an underside of the cover 124 is configured to pierce the capsule 112 when the cover 124 is closed over the capsule 112. To complete a dispensing operation, fluid sourced from one or more of the reservoirs 144 is delivered to the injector 200, thereby entering the capsule 112 and mixing with the solids or other materials within the capsule 112. As also noted above, the capsule holder 132 includes an extractor 204 and an outlet 208, enabling mixed fluid to exit the capsule 112 and the capsule holder 132. In some examples, the extractor 204 itself can also define an outlet, e.g., in the form of an opening traversing the lower wall within the extractor 204.

As will be apparent to those skilled in the art, a given beverage may require fluid from any combination of the reservoirs 144, including as few as one reservoir 144 or as many as all the reservoirs 144. Whichever reservoirs 144 deliver fluid for a given dispensing operation, all dispensed fluid ultimately travels to the injector 200. The apparatus 100 therefore contains conduits connecting the reservoirs 144 to the injector 200, and valves controllable to permit or block passage of fluids along such conduits, dependent on the particular combination of fluids involved in a given dispensing operation.

The presence of multiple reservoirs, the ability to control fluid flow independently from each reservoir, and the need to deliver fluid from multiple sources to a single injector, can lead to the implementation of fluid delivery subsystems prone to leaks or other mechanical failures, and/or prone to residual fluids from an earlier dispensing operation contaminating a subsequent dispensing operation. For example, a previous dispensing apparatus may include conduits travelling from a pair of reservoirs, to respective valves, followed by additional conduits from those valves to a three-way connector. The output of the three-way connector may then be routed via yet another conduit to a further three-way connector, e.g., arranged to receive fluid from the above-mentioned pair of reservoirs as well as a further pair of reservoirs connected via a similar combination of conduits, valves, and connectors. The output of the final connector may then be directed towards the injector, e.g., via a pump.

Fluid delivery subsystems such as that set out above, in other words, employ numerous distinct conduits (e.g., lengths of tubing), each with a pair of connections to other components. Such subsystems may also involve a variety of conduits, connectors, and the like, downstream of the valves controlling fluid release from the reservoirs. The numerous connections between conduits and other components represent points of potential failure leading to leaks, and the portions of the fluid delivery subsystem downstream from the valves may collect residual fluids (i.e., fluid not fully evacuated from the subsystem by the pump) that may contaminate subsequent dispensing operations.

The apparatus 100, in contrast, includes a fluid delivery subsystem with components arranged to reduce the number of distinct conduits and connections relative to the example noted above. The fluid delivery subsystem of the apparatus 100 may also reduce the likelihood of residual fluid accumulating in the subsystem, e.g., by reducing the length of conduits and/or total volume of the subsystem downstream of valves from the reservoirs 144.

Returning briefly to FIG. 1, the above-mentioned fluid delivery subsystem is contained partially in the base 108, as will be discussed further below. The apparatus 100 also includes a housing 152 supported on the base 108, containing a portion of the fluid delivery subsystem in addition to supporting the dispensing head assembly 116 and the reservoir 144*a*. The section lines 156 indicate portions of the apparatus 100 cut away in FIG. 3 to reveal a portion of the fluid delivery subsystem, and the section lines 158 indicate further such portions, as illustrated in FIG. 4.

Figure 3:
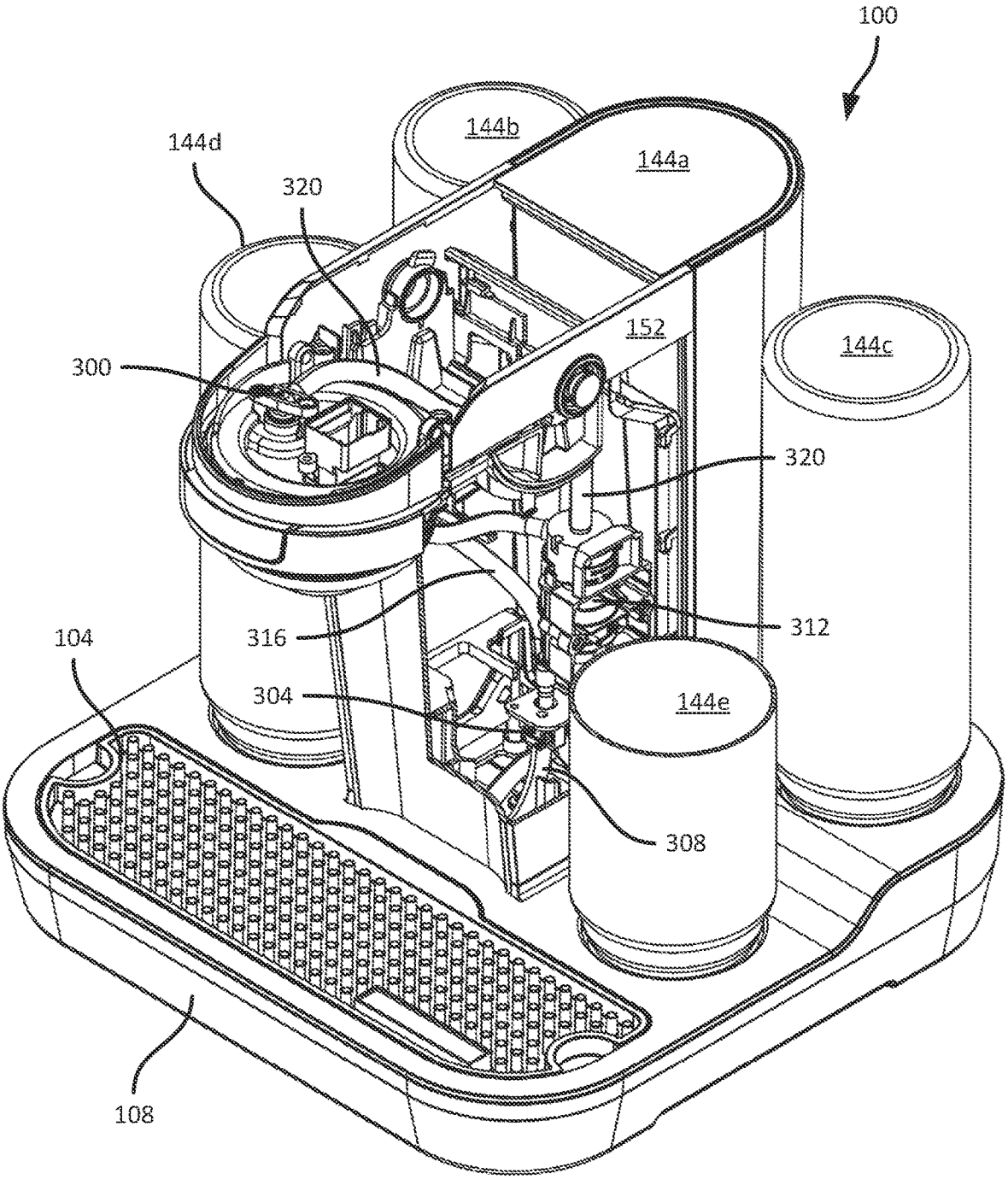
FIG. 3 is an isometric view of the apparatus of FIG. 1, with certain portions cut away to illustrate a fluid delivery subsystem of the apparatus.
Figure 4:
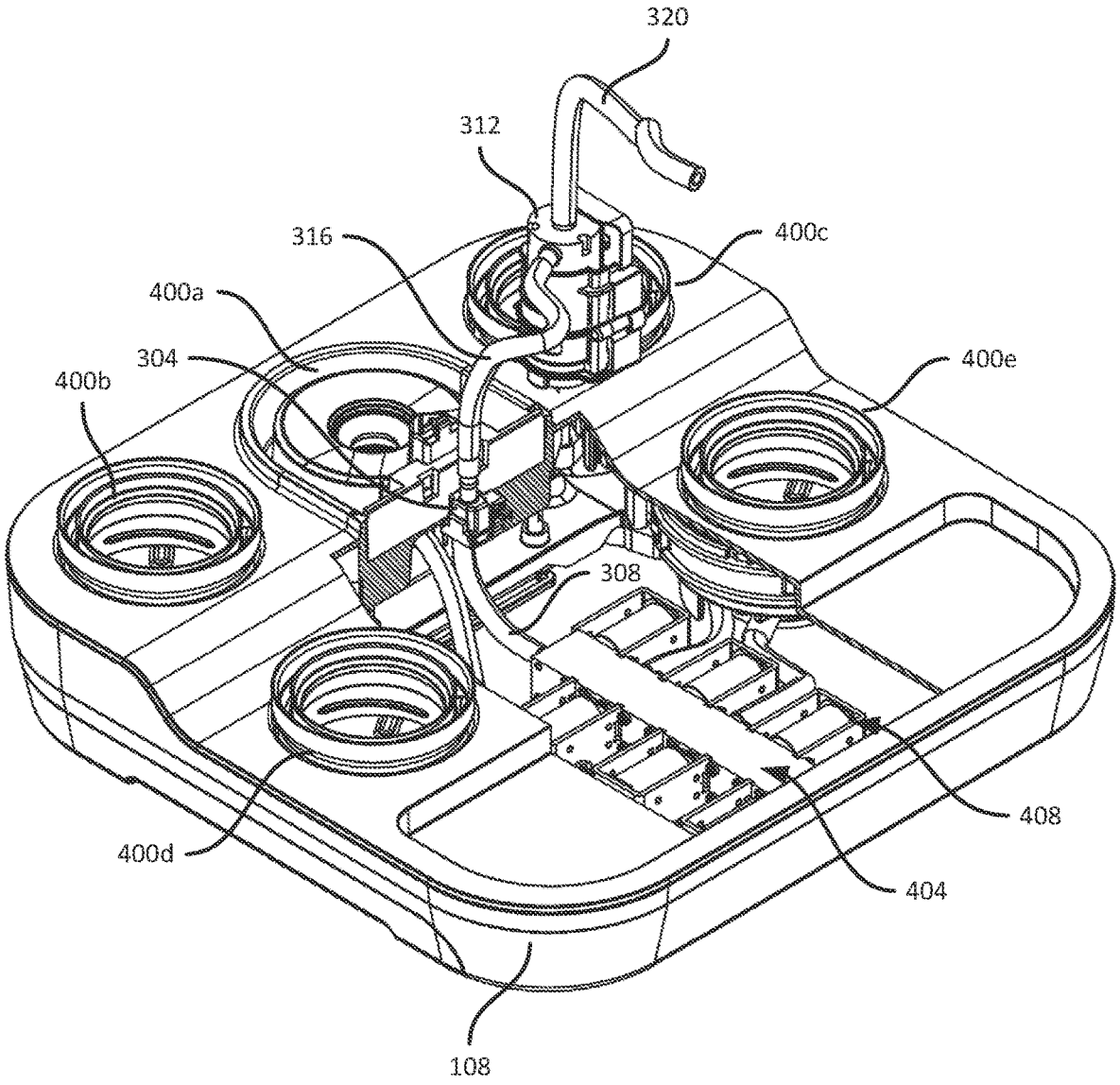
FIG. 4 is an isometric view of the apparatus of FIG. 1, with the reservoirs and housing omitted, and a portion of the base cut away to illustrate additional components of the fluid delivery subsystem.

Turning to FIG. 3, the apparatus 100 is shown with the reservoir 144*e* and the housing 152 sectioned according to the section lines 156 shown in FIG. 1. Of particular note, FIG. 3 illustrates a portion of a fluid delivery subsystem of the apparatus 100, In particular, FIG. 3 illustrates an injection assembly of the fluid delivery subsystem. The injection assembly terminates at a single output 300, which is directly connected to the injector 200. The injection assembly also includes a single fluid input, which in the illustrated example is at a flow sensor 304. In other words, the injection assembly does not receive fluid from any source other than the input at the flow sensor 304, and does not dispense fluid to any location other than the injector 200. The remainder of the fluid delivery subsystem is therefore configured, as will be described below, to route and combine fluids from any combination of reservoirs 144, upstream of the flow sensor 304, into a single conduit 308 connected to the flow sensor 304.

In other examples, the flow sensor 304 can be omitted, and the single input of the injection assembly is instead an input to a pump 312 supported within the housing 152. The conduit 308, in such examples, is therefore connected directly to the pump 312. In the illustrated example, the flow sensor 304 is connected with the pump 312 via an intermediate conduit 316, and the pump 312 is connected to the output 300 via an output conduit 320.

As noted above, upstream of the flow sensor 304 (e.g., the single fluid input of the injection assembly), the fluid delivery subsystem includes various components to receive and combine fluid from any combination of the reservoirs 144, while minimizing the number of fluid connections (e.g., between a conduit and another component) and/or while mitigating against the accumulation of residual fluid.

Turning to FIG. 4, the apparatus 100 is shown with the housing 152, reservoirs 144, and support surface 104 omitted, and a portion of the base 108 cut away according to the section 158 shown in FIG. 1, In addition to the injection assembly set out above (in this example, the sensor 304, conduits 316 and 320, and the pump 312), FIG. 4 illustrates a set of sockets 400*a*, 400*b*, 400*c*, 400*d*, and 400*e* configured to receive, respectively, the reservoirs 144*a*, 144*b*, 144*c*, 144*d*, and 144*e*.

Further components of the fluid delivery subsystem of the apparatus 100 are also shown in FIG. 4, including a fluid delivery manifold 404 and a set of valves 408. As will be discussed below, the manifold 404 is configured to receive fluid from the reservoirs 144 (via the sockets 400 and various fluid conduits), Which reservoirs 144 deliver fluid to the manifold 404 at a given time is controlled by the valves 408. Any fluid in the manifold 404 can then be drawn from the manifold 404, via the conduit 308, to the injection assembly via operation of the pump 312. That is, the manifold 404 has a single outlet, through which all fluid delivered to the injection assembly passes. As seen in FIG. 4, the relatively short length of the conduit 308, and the resulting proximity of the interior of the manifold 404 to the pump 312, reduces the likelihood of residual fluid accumulating in the manifold. Further, the valves 408 are disposed relative to the manifold 404 so as further reduce the likelihood of residual fluid accumulation.

Figure 5:
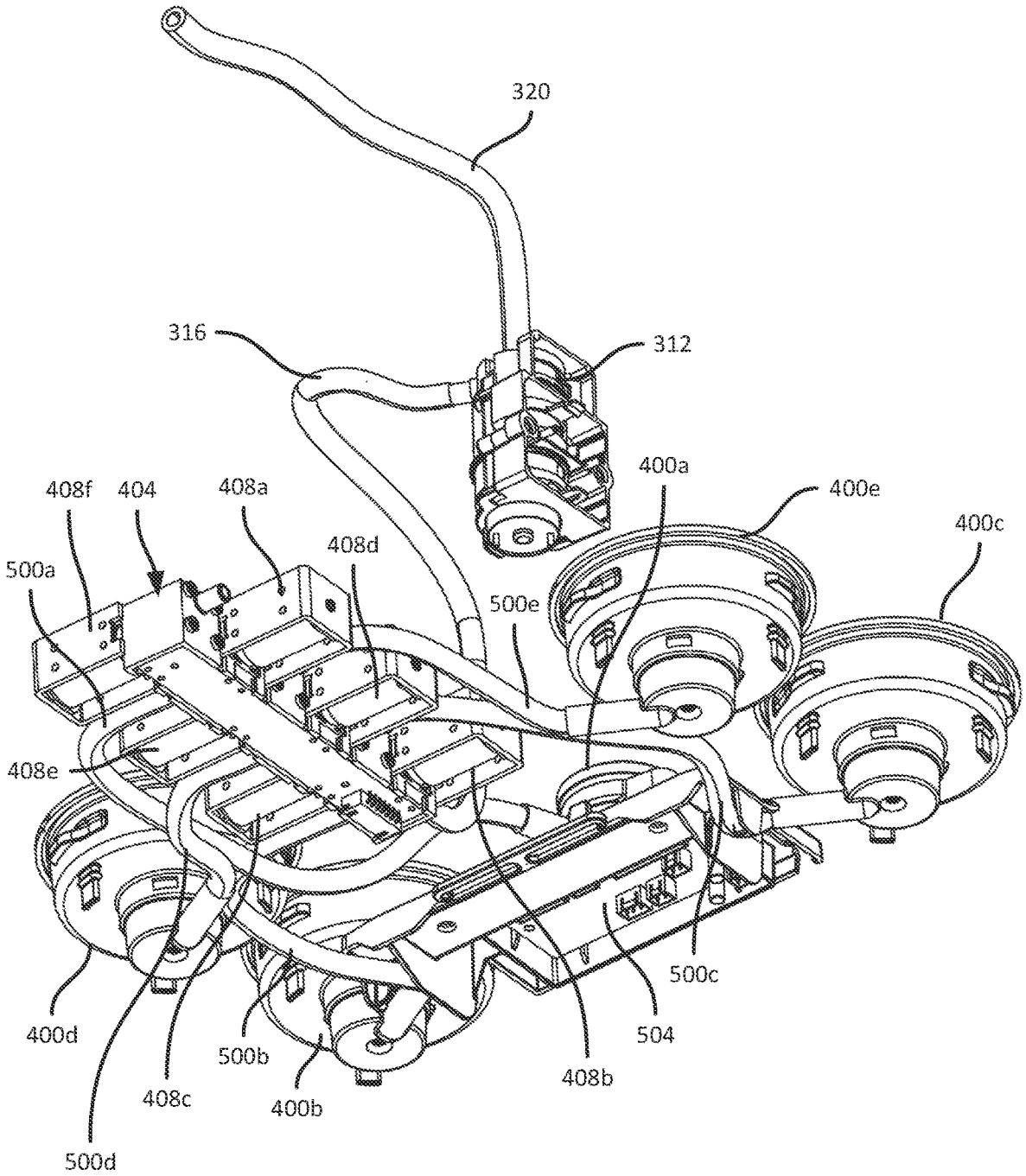
FIG. 5 is a perspective view of the fluid delivery subsystem of the apparatus of FIG. 1, viewed from below.

FIG. 5 illustrates the apparatus 100 from below, omitting both the components omitted in FIG. 4, and the base 104. As shown in FIG. 5, the fluid delivery subsystem includes a set of conduits 500 between the reservoirs 144 (via the sockets 400) and the manifold 404. In particular, the fluid delivery subsystem includes input conduits 500*a*, 500*b*, 500*c*, 500*d*, and 500*e* connected between the sockets 400 and the manifold 404. In the illustrate example, each input conduit 500 is a single, continuous conduit, connected directly between the corresponding socket 400 and the manifold 404. That is, in the illustrated example there are only two connection points between each reservoir 144 and the manifold 404.

FIG. 5 also illustrates the valves 408 in greater detail. In particular, the fluid delivery subsystem includes respective valves 408*a*, 408*b*, 408*c*, 408*d*, and 408*e*, corresponding to the reservoirs 144*a*, 144*b*, 144*c*, 144*d*, and 144*e* respectively. In this example, an additional valve 408*f* is included, for controlling entry of air into the manifold 404. In other words, air can be delivered to the manifold 404 as a sixth fluid, albeit one without a discrete reservoir 144.

Also shown in FIG. 5 is a control assembly 504, including a controller (e.g., an application specific integrated circuit (ASIC) or the like) communicatively coupled with at least the valves 408, the pump 312, and the flow sensor 304. The controller is configured, as will be apparent to those skilled in the art, to control the valves 408 to open or close to allow fluid into the manifold 404 from the relevant reservoirs 144 (e.g., according to a recipe or other data record defining a particular dispensing operation), Simultaneously, the controller can enable the pump 312 to drive the above-mentioned fluid from the manifold 404 to the injector 200.

Figure 6:
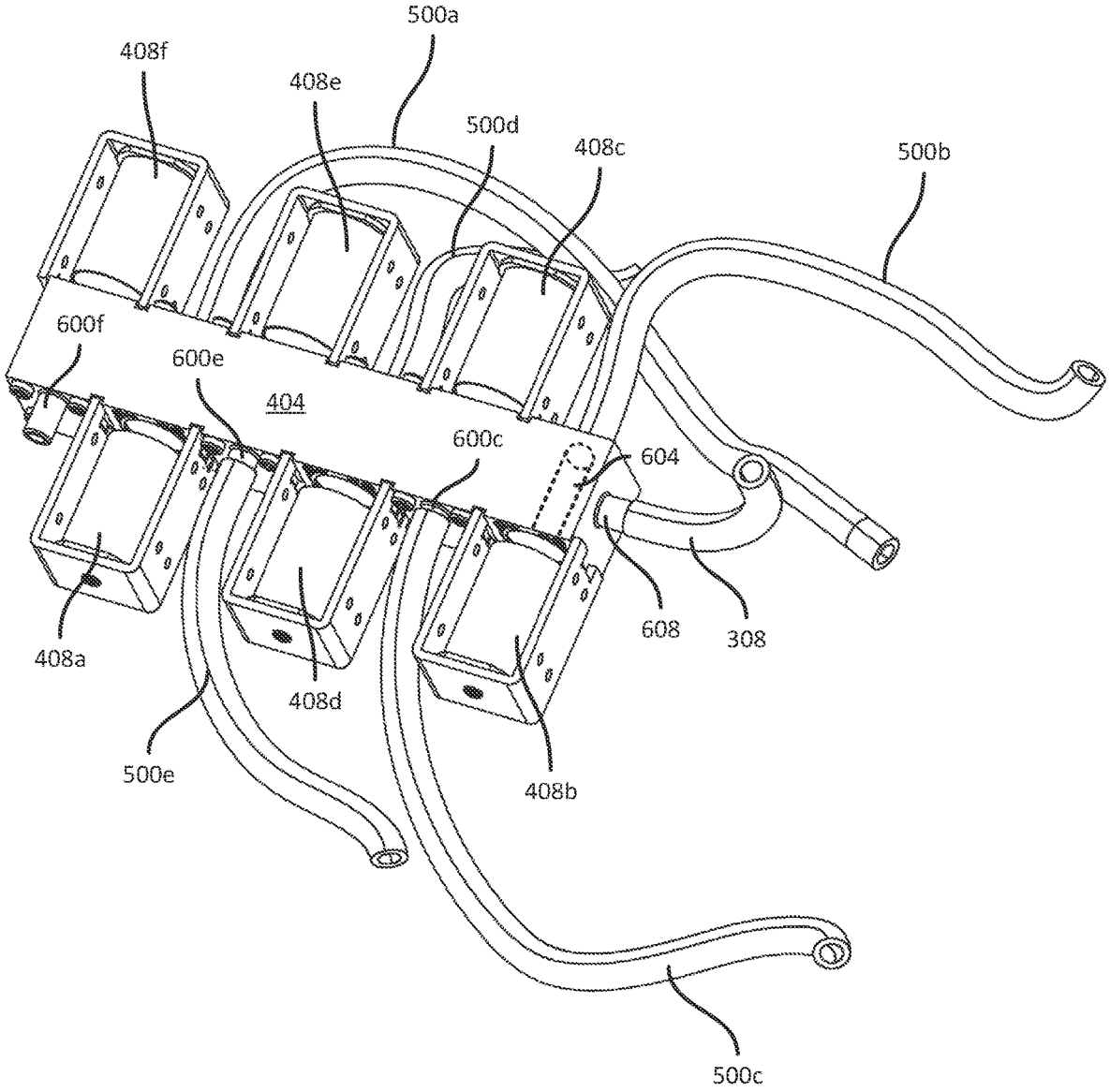
FIG. 6 is a perspective view of the manifold and fluid conduits of the fluid delivery subsystem of FIG. 5, viewed from above.

Turning to FIG. 6, the manifold 404, valves 408, and conduits 500, as well as the conduit 308, are shown in isolation. As seen in FIG. 5, each input conduit 500 connects with the manifold 404 at a corresponding inlet 600. The inlets 600*e* and 600*c* are visible in FIG. 6, as well as an additional inlet 600*f* without a corresponding conduit 500, for entry of air into the manifold 404 via control of the valve 408*f*. Each valve 408 is mounted directly to the manifold 404 at an opposite wall to the corresponding inlet 600. The valves can therefore act directly at the inlets 600, to open or close each inlet 600 without introducing additional conduits (and therefore additional volumes for residual fluid to accumulate) between the valves 408 and the manifold.

In the illustrated example, the valves 408 are linear-action solenoid valves, and may include cores 604 (one example of which is illustrated) that can extend into the chamber defined inside the manifold 404, to block the opposite inlet 600, or withdraw from the chamber to open the opposite inlet 600. Any fluid thus permitted to enter the chamber of the manifold 404 exits the manifold via a single chamber outlet 608, to which the conduit 308 is connected.

As seen from FIGS. 4-6, the inlets 600 of the manifold 404 are disposed at a lower elevation (when the apparatus 100 is in use, with the base 108 resting on a substantially horizontal surface) than the reservoirs 144. Fluid can therefore be allowed into the manifold by gravity, in addition to or instead of operation of the pump 312.

The scope of the claims should not be limited by the embodiments set forth in the above examples, but should be given the broadest interpretation consistent with the description as a whole,

The invention claimed is:

1. A beverage dispensing apparatus, comprising:

a plurality of reservoirs configured to supply respective fluids for delivery to an injection assembly having a single fluid input;

a fluid delivery manifold defining a chamber, and having (i) for each of the reservoirs, a respective chamber inlet, and (ii) a single chamber outlet;

for each chamber inlet, a respective valve mounted to the manifold and configured to selectably open or close the corresponding chamber inlet;

for each reservoir, a respective input conduit connected to a corresponding chamber inlet, to deliver fluid from the reservoir into the chamber; and an output conduit connected between the single chamber outlet and the single fluid input of the injection assembly, to deliver fluid from the chamber to the injection assembly.

2. The beverage dispensing apparatus of claim 1, wherein the injection assembly includes a pump, an injector, and a conduit between the pump and the injector.

3. The beverage dispensing apparatus of claim 2, further comprising:

a controller coupled with the valves and the pump;

wherein the controller is configured to open at least a subset of the valves to release fluid into the chamber, and simultaneously, to enable the pump to draw the fluid released fluid from the chamber for delivery to the injector.

4. The beverage dispensing apparatus of claim 2, wherein the injection assembly further includes a flow sensor defining the single fluid input, and a fluid conduit between the flow sensor and the pump; and wherein the output conduit extends between the single chamber outlet, and the single fluid input at the flow sensor.

5. The beverage dispensing apparatus of claim 1, wherein each input conduit is a single, continuous conduit between the corresponding reservoir and the corresponding chamber input.

6. The beverage dispensing apparatus of claim 1, wherein each chamber input is disposed in a wall of the fluid delivery manifold;

wherein the corresponding valve is disposed at an opposite wall of the fluid delivery manifold; and wherein the valve includes an actuator controllable to extend through the opposite wall and the chamber to close the corresponding chamber inlet.

7. The beverage dispensing apparatus of claim 6, wherein the valves are linear action solenoid valves.

8. The beverage dispensing apparatus of claim 1, wherein the chamber inlets are disposed at a first elevation, and the reservoirs are disposed at at least a second elevation greater than the first elevation.

* * * * *